US006847929B2

(12) United States Patent
Bernard

(10) Patent No.: US 6,847,929 B2
(45) Date of Patent: Jan. 25, 2005

(54) ALGEBRAIC CODEBOOK SYSTEM AND METHOD

(75) Inventor: Alexis P. Bernard, Los Angeles, CA (US)

(73) Assignee: Texas Instruments Incorporated, Dallas, TX (US)

( * ) Notice: Subject to any disclaimer, the term of this patent is extended or adjusted under 35 U.S.C. 154(b) by 515 days.

(21) Appl. No.: 09/970,317

(22) Filed: Oct. 3, 2001

(65) Prior Publication Data

US 2002/0111799 A1 Aug. 15, 2002

Related U.S. Application Data

(60) Provisional application No. 60/239,730, filed on Oct. 12, 2000.

(51) Int. Cl.[7] ..... G10L 19/08

(52) U.S. Cl. ..... 704/223; 704/219; 704/220; 704/222; 704/262

(58) Field of Search ..... 704/219, 220, 704/222, 223, 262; 341/451

(56) References Cited

U.S. PATENT DOCUMENTS

| | | | | | |
|---|---|---|---|---|---|
| 5,822,724 | A | * | 10/1998 | Nahumi | 704/223 |
| 5,893,061 | A | * | 4/1999 | Gortz | 704/262 |
| 5,970,444 | A | * | 10/1999 | Hayashi et al. | 704/223 |
| 6,236,960 | B1 | * | 5/2001 | Peng et al. | 704/211 |
| 6,714,907 | B2 | * | 3/2004 | Gao | 704/220 |
| 6,728,669 | B1 | * | 4/2004 | Benno | 704/219 |

* cited by examiner

*Primary Examiner*—W. R. Young
*Assistant Examiner*—Dmitry Brant
(74) *Attorney, Agent, or Firm*—Carlton H. Hoel; W. James Brady; Frederick J. Telecky, Jr.

(57) ABSTRACT

Code-excited linear prediction speech encoders/decoders with excitation including an algebraic codebook contribution encoded with a single sign bit for each track of pulses by inferring pulse amplitude signs from the pulse position code ordering within a codeword.

2 Claims, 3 Drawing Sheets

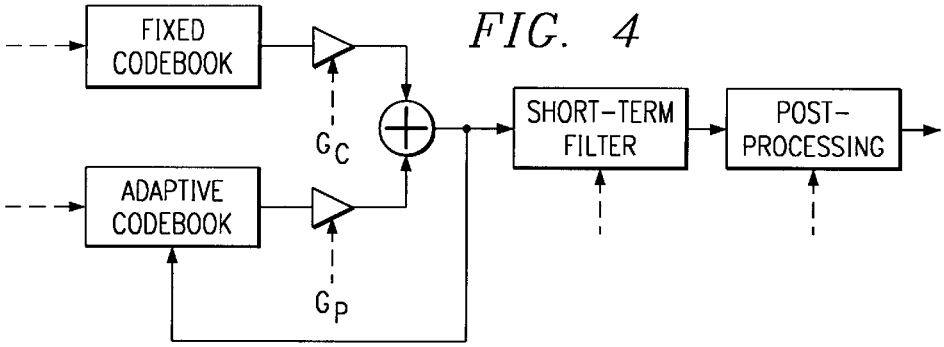
FIG. 4
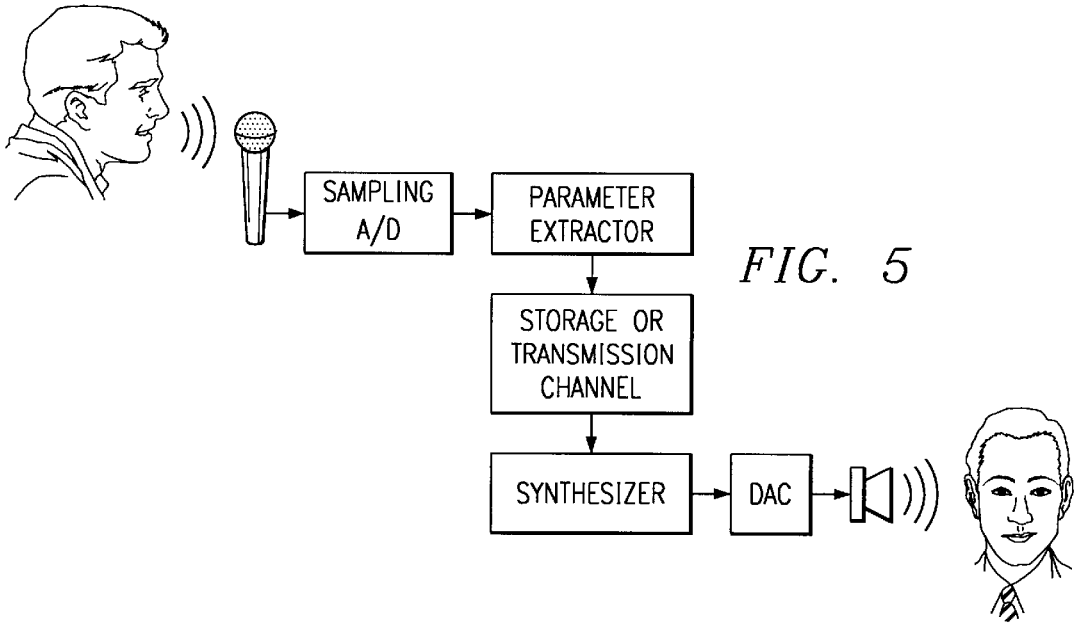
FIG. 5
FIG. 6
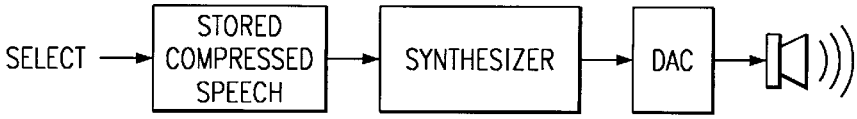

ALGEBRAIC CODEBOOK SYSTEM AND METHOD

CROSS-REFERENCE TO RELATED APPLICATIONS

This application claims priority from provisional applications: Ser. No. 60/239,730, filed Oct. 12, 2000. The following patent applications disclose related subject matter: Ser. Nos. 10/769,243, 10/769,500, 10/769,501, and 10/769,696, all filed Jan. 30, 2004. These referenced applications have a common assignee with the present application.

BACKGROUND OF THE INVENTION

The invention relates to electronic devices, and, more particularly, to encoding and decoding with algebraic codebooks and systems employing such algebraic codebooks.

The performance of digital speech systems using low bit rates has become increasingly important with current and foreseeable digital communications. Both dedicated channel and packetized-over-network (VoIP) transmission benefit from compression of speech signals. The widely-used linear prediction (LP) digital speech coding compression method models the vocal tract as a time-varying filter and a time-varying excitation of the filter to mimic human speech. Linear prediction analysis determines LP coefficients a(j), j=1, 2, . . . , M, for an input frame of digital speech samples {s(n)} by setting $$r(n)=s(n)-\Sigma_{M\geqq j\geqq 1}a(j)s(n-j) \quad (1)$$

and minimizing $\Sigma r(n)^2$. Typically, M, the order of the linear prediction filter, is taken to be about 10–12; the sampling rate to form the samples s(n) is typically taken to be 8 kHz (the same as the public switched telephone network (PSTN) sampling for digital transmission); and the number of samples {s(n)} in a frame is often 80 or 160 (10 or 20 ms frames). Various windowing operations may be applied to the samples of the input speech frame. The name "linear prediction" arises from the interpretation of $r(n)=s(n)-\Sigma_{M\geqq j\geqq 1} a(j)s(n-j)$ as the error in predicting s(n) by the linear combination of preceding speech samples $\Sigma_{M\geqq j\geqq 1} a(j)s(n-j)$. Thus minimizing $\Sigma r(n)^2$ yields the set of coefficients {a(j)} which furnish the best linear prediction. The coefficients {a(j)} may be converted to line spectral frequencies (LSFs) for quantization and transmission or storage.

The {r(n)} form the LP residual for the frame, and ideally the LP residual would be the excitation for the synthesis filter 1/A(z) where A(z) is the transfer function of equation (1). Of course, the LP residual is not available at the decoder; thus the task of the encoder is to represent the LP residual so that the decoder can generate an LP excitation from the encoded parameters. Physiologically, for voiced frames the excitation roughly has the form of a series of pulses at the pitch frequency, and for unvoiced frames the excitation roughly has the form of white noise.

The LP compression approach basically only transmits/stores updates for the (quantized) filter coefficients, the (quantized) excitation (waveform or parameters such as pitch), and the (quantized) gain. A receiver regenerates the speech with the same perceptual characteristics as the input speech. FIGS. 5–6 show the high level blocks in an LP system. Periodic updating of the quantized items requires fewer bits than direct representation of the speech signal, so a reasonable LP coder can operate at bits rates as low as 2–3 kb/s (kilobits per second).

Indeed, the ITU standard G.729 with a bit rate of 8 kb/s uses LP analysis with code excitation (CELP) to compress voiceband speech and has performance essentially equivalent to the 32 kb/s ADPCM of ITU standard G.726. FIG. 2 illustrates CELP synthesis. The excitation in G.729 consists of the sum of an adaptive codebook contribution and a fixed (algebraic) codebook contribution; FIGS. 3–4 show the generic encoder and decoder. The adaptive codebook contribution provides periodicity (pitch) for the excitation, and the algebraic codebook contribution provides the remainder. Each algebraic codebook vector contains four ±1 pulses with one pulse in each of four interleaved tracks of 8 or 16 positions, the tracks make up the 40 component vector corresponding to a 40 sample subframe excitation. Indeed, the excitation for a subframe will roughly be the sum of a gain times the prior subframe's excitation but time shifted by a pitch delay plus a gain times the algebraic codebook vector. In more detail, the algebraic codebook vector has 40 positions (labeled 0 through 39) with one ±1 pulse among the eight positions 0, 5, 10, 15, 20, 25, 30, and 35 which make up track 0; one ±1 pulse among the eight positions 1, 6, 11, 16, 21, 26, 31, and 36 which constitute track 1; one ±1 pulse among the eight components 2, 7, 12, 17, 22, 27, 32, and 37 forming track 2; and one ±1 pulse among the 16 positions 3, 4, 8, 9, 13, 14, 18, 19, 23, 24, 28, 29, 33, 34, 38, and 39 forming track 3. All 36 positions without pulses equal 0. Note that this splitting of the 40 positions into four interleaved tracks with one ±1 pulse in each track somewhat reduces the possible positions of four ±1 pulses among the 40 positions but greatly reduces the number of bits required to encode the pulses. In fact, the location of a pulse among eight positions takes 3 bits, the location of a pulse among 16 positions takes 4 bits, and the sign of each pulse takes 1 bit; thus the total to encode the vector is 17 bits. In contrast, a pulse position among 40 components takes 6 bits and again a sign of a pulse takes 1 bit, thus the total to encode four ±1 pulses located anywhere in the 40 positions would take 28 bits.

Similarly, the GSM Enhanced Full Rate (EFR) standard uses CELP including algebraic codebook vectors having a total of ten pulses in a 40-position vector with two ±1 pulses on each of five interleaved tracks, each track has eight positions for the 40-sample excitation. That is, there are two ±1 pulses located among the eight positions 0, 5, 10, 15, 20, 25, 30, and 35; two ±1 pulses among the eight positions 1, 6, 11, 16, 21, 26, 31, and 36; two ±1 pulses among the eight positions 2, 7, 12, 17, 22, 27, 32, and 37; two ±1 pulses among the eight positions 3, 8, 3, 18, 23, 28, 33, and 38; two ±1 pulses among the eight positions 4, 9, 14, 19, 24, 29, 34, and 39. The vector equals 0 at the 30 non-pulse positions. This appears to require 40 bits, but the encoding of the sign bits can be reduced from 2 bits for two pulses on the same track to only 1 bit as follows. A single sign bit indicates the sign of the first transmitted pulse position within the track; and the sign of the second transmitted pulse depends upon its position relative to that of the first pulse: if the position of the second pulse is smaller (precedes) that of the first pulse, then the second pulse has the opposite sign, otherwise it has the same sign. Thus 5 bits are saved. Note that two pulses may have the same position (in effect one pulse of twice the amplitude).

In general, with 2n pulses per track in an algebraic codebook, only n sign bits are needed because the pulses can be paired with the first pulse in a pair having the sign bit and the second pulse in the pair having the opposite or same sign according to relative pulse position.

Further, CELP codecs with algebraic codebooks have been proposed for wideband speech and audio coding at rates such as 16 kb/s and 24 kb/s. However, the algebraic codebook vectors still require too many bits for encoding more than two pulses per track.

SUMMARY OF THE INVENTION

The present invention provides algebraic codebook vector encoding and decoding using the order of the pulse position codes within the codeword for pulse amplitude sign encoding.

This has advantages including fewer bits needed for coding.

BRIEF DESCRIPTION OF THE DRAWINGS

FIGS. 3–4 show in block format encoding and decoding.

FIGS. 5–6 are block diagrams of systems.

DETAILED DESCRIPTION OF THE PREFERRED EMBODIMENTS

1. Overview

The preferred embodiment systems include preferred embodiment speech encoders and decoders which use algebraic codebooks wherein the order of the pulse position codes within a codeword encode the pulse amplitude signs. In particular, for each track of pulse positions, one of the pulses is chosen as the pivot pulse, and all other pulses in the track with position codes listed prior to the pivot pulse position code will have negative pulse amplitude signs, and all pulses with position codes listed after the pivot pulse position code will have positive pulse amplitude signs. Hence, only the sign of the pivot pulse (1 bit) need be encoded for all pulses in a track, so there will be a single track sign bit. The pivot pulse needs to be uniquely identifiable among the pulses in the track; for example, the pivot pulse could be the pulse with the smallest pulse position in the track. Decoding for a track simply finds the pivot pulse position and deduces the remaining pulse amplitude signs from the pulse position code locations in the codeword. This provides bit savings over standard algebraic codebook codes for codes with three or more pulses on a track.

2. First Preferred Embodiment Systems

FIGS. 3–6 show in functional block format a first preferred embodiment system for speech encoding, transmission (storage), and decoding including first preferred embodiment encoders and decoders. The encoders and decoders use CELP with excitations having contributions from both an adaptive (pitch) codebook and a fixed (algebraic) codebook with the algebraic codebooks having preferred embodiment pulse position code ordering within a codeword determining the pulse amplitude signs.

3. Encoder Details

Figure 3:
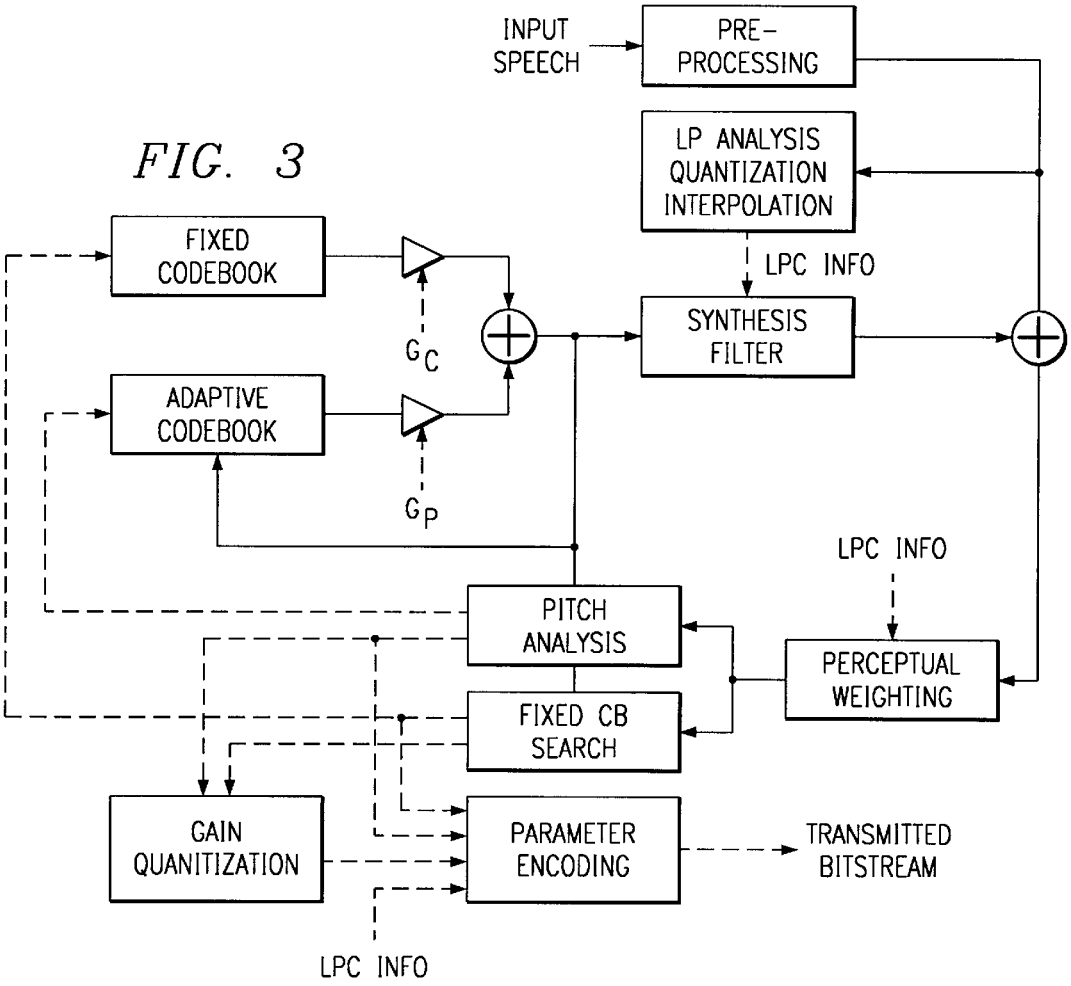

FIG. 3 illustrates the flow of a first preferred embodiment speech encoder employing preferred embodiment algebraic codebook coding (shown in FIG. 1*a*) with the following steps.

(1) Sample an input speech signal (which may be preprocessed to filter out dc and low frequencies, etc.) at 8 kHz or 16 kHz to obtain a sequence of digital samples, s(n). Partition the sample stream into 80-sample or 160-sample frames (e.g., 10 ms frames) or other convenient frame size. The analysis and coding may use various size subframes of the frames.

(2) For each frame (or subframes) apply linear prediction (LP) analysis to find LP (and thus LSF/LSP) coefficients and quantize the coefficients.

(3) Find a pitch delay by searching correlations of s(n) with s(n+k) in a windowed range; s(n) may be perceptually filtered prior to the pitch search. The search may be in two stages: an open loop search using correlations of s(n) to find a pitch delay followed by a closed loop search to refine the pitch delay by interpolation from maximizations of the normalized inner product $\langle x|y\rangle$ of the target speech x(n) in the (sub)frame with the speech y(n) generated by the (sub) frame's quantized LP synthesis filter applied to the prior (sub)frame's excitation. The adaptive codebook vector v(n) is thus the prior (sub)frame's excitation translated by the refined pitch delay.

(4) Determine the adaptive codebook gain, $g_p$, as the ratio of the inner product $\langle x|y\rangle$ divided by $\langle y|y\rangle$ where x(n) is the target speech in the (sub)frame and y(n) is the speech in the (sub)frame generated by the quantized LP synthesis filter applied to the adaptive codebook vector v(n) from step (3). Thus $g_p v(n)$ is the adaptive codebook contribution to the excitation and $g_p y(n)$ is the adaptive codebook contribution to the speech in the (sub)frame.

(5) Find the algebraic codebook vector c(n) by essentially maximizing the correlation of quantized LP synthesis filtered c(n) with $x(n)-g_p y(n)$ as the target speech in the (sub)frame; that is, remove the adaptive codebook contribution to have a new target. In particular, search over possible algebraic codebook vectors c(n) to maximize the ratio of the square of the correlation $\langle x-g_p y|H|c\rangle$ divided by the energy $\langle c|H^T H|c\rangle$ where h(n) is the impulse response of the quantized LP synthesis filter (with perceptual filtering) and H is the lower triangular Toeplitz convolution matrix with diagonals h(0), h(1), . . . The vectors c(n) have 40 positions in the case of 40-sample (5 ms for 8 kHz sampling rate) (sub)frames being used as the encoding granularity, and the 40 samples are partitioned into five interleaved tracks with 6 pulses positioned within each track of 8 samples.

Figure 1A:
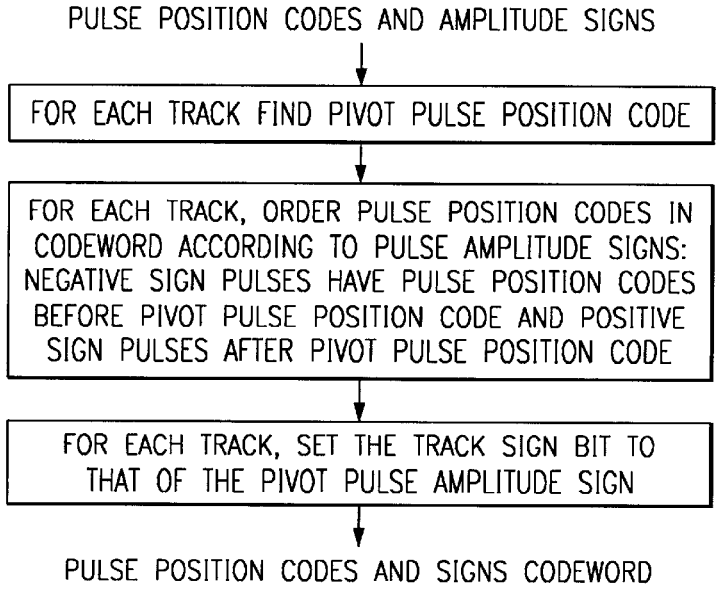
FIGS. 1*a*–1*b* are flow charts for a preferred embodiment.

Form a codeword from the codes of the pulse positions and amplitude signs as follows and illustrated in FIG. 1*a*. First, for convenience label the 40 sample positions as 0, 1, 2, . . . , 38, 39. Partition the 40 samples into 5 interleaved tracks of 8 samples each: track 0 consists of sample positions 0, 5, 10, 15, 20, 25, 30, and 35; track 1 the positions 1, 6, 11, 16, 21, 26, 31, and 36; track 2 the positions 2, 7, 12, 17, 22, 27, 32, and 37; track 3 the positions 3, 8, 13, 18, 23, 28, 33, and 38; and track 4 the positions 4, 9, 14, 19, 24, 29, 34, and 39. Then presume that each track will have 6 pulses, each pulse with amplitude ±1, and with pulses adding amplitudes if they have the same position. The total number of pulses is 30, although other preferred embodiments have a differing total number of pulses and/or a differing track number or partitioning and/or a differing total number of positions in a codebook vector.

Each of the pulse positions is encoded with 3 bits to represent one of the 8 positions in a track, and the set of track position codes are in track order. That is, the 6 pulses for track 0 constitute the first 6 entries in the codeword for the vector c(n), the 6 pulses of track 1 are the next 6 entries, and so forth. And the preferred embodiment encoding of the signs of the 6 pulse amplitudes in each track reduces to a single bit for the track. First, for track 0 find the smallest pulse position of the 6 pulse positions; call this pulse position the pivot position. For example, if the 6 pulses in track 0 were: −1 at 10, +1 at 15, −1 at 25, −1 at 30, +1 at 35, and another +1 at 35, then the pivot position would be 10. (Note that position 0 is coded as 000, position 5 as 001, position 10 as 010, and so forth up to position 35 as 111.)

Next, put the pulse position codes for track 0 in order in the codeword so that the positions of the non-pivot pulses with negative amplitude precede the pivot position and the non-pivot pulses with positive amplitude follow the pivot position: e.g., the track 0 positions are ordered in the codeword as 101 (25), 110 (30), 010 (10, the position of the pivot), 011 (15), 111 (35), and 111 (35). Then put the code bit for the sign of the pivot pulse as the first bit of the track 0 portion of the codeword. For the example the track 0 sign bit equals 0 (the pivot pulse has negative amplitude: use 0 for negative and 1 for positive. Thus the 19-bit track 0 portion of the codeword is 0 101 110 010 011 111 111.

Repeat for track 1 to obtain the next 19 bits of the codeword. And similarly repeat for each of tracks 2, 3, and 4. Thus the preferred embodiment provides an encoding of the 30 pulses on the 5 tracks using 95 bits and saves 25 bits over the straightforward encoding each pulse with both its position in its track (3 bits) and its sign (1 bit) for a total of 120 bits. The preferred embodiment encoding also saves 10 bits over encoding each pulse with its position in its track (3 bits) plus using one sign bit per pair of pulses (½ bit per pulse) for a total of 105 bits.

Note that the order of the pulse position codes for negative sign pulses and the order of the pulse position codes for positive sign pulses could also include some further information. For example, the negative sign pulse position codes and the positive sign pulse position codes could each be in order (either increasing or decreasing) and a detected misordering at the receiver would indicate an error.

(6) Determine the algebraic codebook gain, $g_c$, by minimizing $|x-g_p y-g_c z|$ where, as in the foregoing description, x(n) is the target speech in the (sub)frame, $g_p$ is the adaptive codebook gain, y(n) is the quantized LP synthesis filter applied to v(n), and z(n) is the signal in the frame generated by applying the quantized LP synthesis filter to the algebraic codebook vector c(n).

(7) Quantize the gains $g_p$ and $g_c$ for insertion as part of the codeword; the algebraic codebook gain may factored and predicted, and the gains may be jointly quantized with a vector quantization codebook. The excitation for the (sub) frame is $u(n)=g_p v(n)+g_c c(n)$, and the excitation memory is updated for use with the next (sub)frame.

Note that all of the items quantized typically would be differential values with the preceding frame's values used as predictors. That is, only the differences between the actual and the predicted values would be encoded.

The final codeword encoding the (sub)frame would include bits for the quantized LSF/LSP coefficients, adaptive codebook pitch delay, algebraic codebook vector with preferred embodiment encoding, and the quantized adaptive codebook and algebraic codebook gains.

4. Decoder Details

A first preferred embodiment decoder and decoding method essentially reverses the encoding steps for a bitstream encoded by the preferred embodiment encoding method. In particular, for a coded (sub)frame in the bitstream:

(1) Decode the quantized LP coefficients. The coefficients may be in differential LSP form, so a moving average of prior frames' decoded coefficients may be used. The LP coefficients may be interpolated every 20 samples in the LSP domain to reduce switching artifacts.

(2) Decode the adaptive codebook quantized pitch delay, and apply this pitch delay to the prior decoded (sub)frame's excitation to form the decoded adaptive codebook vector v(n).

Figure 1B:
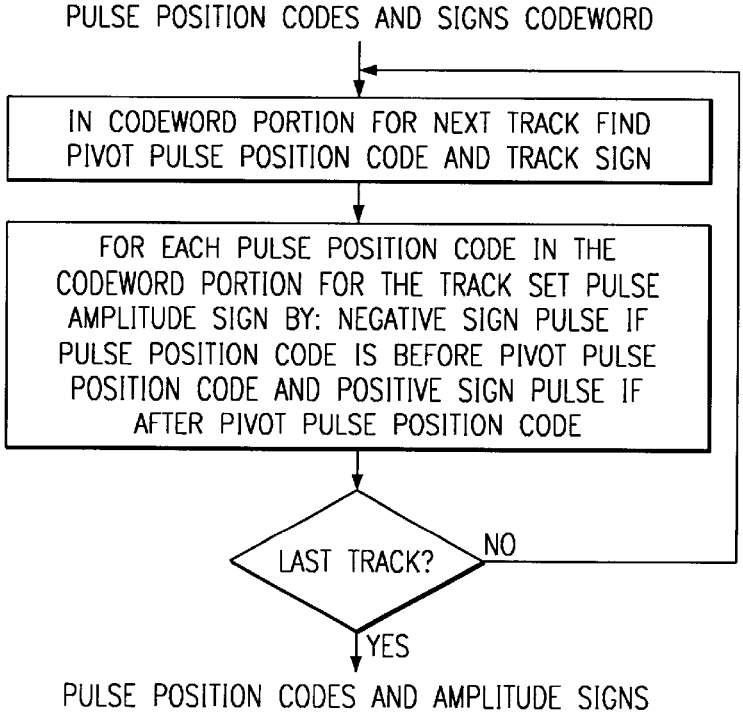
Figure 2:
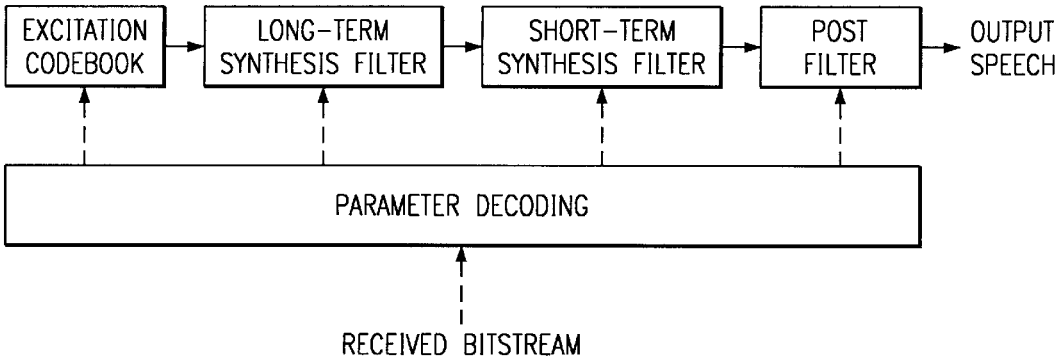
FIG. 2 illustrates conceptual CELP synthesis.

(3) Decode the algebraic codebook vector (see FIG. 1*b*). As described in the foregoing encoding, the track 0 sign bit (for the pivot pulse) is followed by the position codes for the pulses with negative amplitudes, the pivot pulse position code, and then the position codes for the pulses with positive amplitudes. Thus find the smallest position code (the pivot pulse position code) in the first group of 19 bits which relate to the track 0. Thus in the previously described example codeword portion 0 101 110 010 011 111 111 the 010 is the smallest position code, so the pivot pulse is at position 10 and has a negative amplitude from the first 0 bit of the codeword portion. Further, the pulse position codes 101 and 110 preceding the 010 indicate positions 20 and 25 have negative amplitude pulses, and pulse position codes 011, 111, and 111 following the 010 indicate a positive amplitude pulse at position 15 and a double positive amplitude pulse at position 35.

(4) Decode the quantized adaptive codebook and algebraic codebook gains, $g_p$ and $g_c$.

(5) Form the excitation for the (sub)frame as $u(n)=g_p v(n)+g_c c(n)$ where v(n) derives from the excitation memory as the excitation of the prior (sub)frame, c(n) derives from step (3), and $g_p$ and $g_c$ derive from step (4).

(6) Synthesize speech by applying the LP synthesis filter from step (1) to the excitation from step (5).

(7) Apply any post filtering and other shaping actions.

5. Alternative Size Preferred Embodiments

Alternative size preferred embodiment algebraic codebook vector encoding methods and coders and decoders follow the first preferred embodiment methods and coders and decoders but employ different parameters for the algebraic codebook vectors. In particular, the number of components in a codebook vector can vary and the partitioning into tracks likewise can vary. For example, the size of frames and subframes in speech applications of an algebraic codebook typically can range from 10 samples to 160 samples, and the track size typically ranges from 4 to 16. Further, the number of pulses in a vector can vary widely, and the following tables compare the number of sign bits required by the three methods: one sign bit per pulse, one sign bit per pair of pulses, and the preferred embodiment sign encoding by position code ordering. The number of sign bits is listed as a function of the number of pulses per track, the number of tracks per (sub)frame, and the frame size.

First, for 80-sample frames (e.g., 10 ms at 8 kHz sampling rate) and two 40-sample subframes per frame:

| track length | pulses per track | sign bits/frame one per pulse | signs bits/frame one per pair | sign bits/frame pref. embod. |
|---|---|---|---|---|
| 8 | 1 | 10 | 10 | 10 |
| 8 | 2 | 20 | 10 | 10 |
| 8 | 3 | 30 | 20 | 10 |
| 8 | 4 | 40 | 20 | 10 |
| 8 | 5 | 50 | 30 | 10 |
| 8 | 6 | 60 | 30 | 10 |
| 8 | 7 | 70 | 40 | 10 |
| 8 | 8 | 80 | 40 | 10 |
| 10 | 1 | 8 | 8 | 8 |
| 10 | 2 | 16 | 8 | 8 |
| 10 | 3 | 24 | 16 | 8 |
| 10 | 4 | 32 | 16 | 8 |
| 10 | 5 | 40 | 24 | 8 |
| 10 | 6 | 48 | 24 | 8 |
| 10 | 7 | 56 | 32 | 8 |
| 10 | 8 | 64 | 32 | 8 |

Then for 160-sample frames (e.g., 10 ms at 16 kHz sampling rate) and four 40-sample subframes per frame:

| track length | pulses per track | sign bits/frame one per pulse | signs bits/frame one per pair | sign bits/frame pref. embod. |
|---|---|---|---|---|
| 8 | 1 | 20 | 20 | 20 |
| 8 | 2 | 40 | 20 | 20 |
| 8 | 3 | 60 | 40 | 20 |
| 8 | 4 | 80 | 40 | 20 |
| 8 | 5 | 100 | 60 | 20 |
| 8 | 6 | 120 | 60 | 20 |
| 8 | 7 | 140 | 80 | 20 |
| 8 | 8 | 160 | 80 | 20 |
| 10 | 1 | 16 | 16 | 16 |
| 10 | 2 | 32 | 16 | 16 |
| 10 | 3 | 48 | 32 | 16 |
| 10 | 4 | 64 | 32 | 16 |
| 10 | 5 | 80 | 48 | 16 |
| 10 | 6 | 96 | 48 | 16 |
| 10 | 7 | 112 | 64 | 16 |
| 10 | 8 | 128 | 64 | 16 |

These tables show the bit savings using the preferred embodiment encoding and decoding for the algebraic codebook vectors.

Similar bit savings occur with the preferred embodiment coding applied to (sub)frames partitioned into varying size tracks such as: 40-sample subframes partitioned into two 16-position tracks plus an 8-position track or into one 16-position track plus three 8-position tracks or into three 8-position tracks plus four 4-position tracks. Similarly, 20-sample subframes may be partitioned such as two 8-position tracks plus a 4-position track and so forth.

6. System Preferred Embodiments

The preferred embodiment algebraic codebook vector sign codings can be implemented as part of various coders and decoders. For example, wide bandwidth speech encoders and decoders could use a narrow band coder with preferred embodiment CELP for a lowband plus a separate coder for one or more highbands.

FIGS. 5–6 show in functional block form preferred embodiment systems which use the preferred embodiment encoding and decoding. The encoding and decoding can be performed with digital signal processors (DSPs) or general purpose programmable processors or application specific circuitry or systems on a chip such as both a DSP and RISC processor on the same chip with the RISC processor controlling. Codebooks would be stored in memory at both the encoder and decoder, and a stored program in an onboard ROM or external flash EEPROM for a DSP or programmable processor could perform the signal processing. Analog-to-digital converters and digital-to-analog converters provide coupling to the real world, and modulators and demodulators (plus antennas for air interfaces) provide coupling for transmission waveforms. The encoded speech can be packetized and transmitted over networks such as the Internet.

7. Modifications

The preferred embodiments may be modified in various ways while retaining the features of inferring pulse signs from coding order of pulse positions of a vector of an algebraic codebook.

For example, the pivot pulse could be any uniquely identifiable pulse, such as the pulse with the smallest position (as in the foregoing preferred embodiment), the largest position, the median position, and so forth. The pulse amplitude signs of the preceding and following pulse position codes relative to the pivot pulse position code could be reversed from the preferred embodiments or coincide with/be opposite of the pivot pulse amplitude sign, and so forth. The number of pulses in a track may vary from track to track in a vector. The pivot pulse could be identified in different manners in different tracks with the same vector.

What is claimed is:

1. A method of algebraic codebook vector encoding, comprising:

(a) finding a pivot pulse position in a track of positions of a algebraic codebook vector, said track having three or more pulses which may have coincident positions; and (b) ordering pulse position codes for pulse positions in said track with respect to a pulse position code for said pivot pulse position to encode pulse amplitude signs of pulses associated with said pulse positions.

2. The method of claim 1, wherein:

(a) the number of unit amplitude pulses in said track equals three, wherein when two or three pulses have the same position, their amplitudes add.

* * * * *